United States Patent [19]

Sawai

[11] 4,157,630

[45] Jun. 12, 1979

[54] MAGNET EQUIPPED TOY THAT CHANGES POSTURE

[75] Inventor: Suezo Sawai, Kyoto, Japan

[73] Assignee: Nichiten Shosan Kabushiki Kaisha, Kyoto, Japan

[21] Appl. No.: 774,688

[22] Filed: Mar. 7, 1977

[30] Foreign Application Priority Data

Mar. 18, 1976 [JP] Japan ..... 51-33598[U]

[51] Int. Cl.[2] ..... A63H 33/00

[52] U.S. Cl. ..... 46/3; 46/161; 46/237

[58] Field of Search ..... 46/238, 237, 236, 235, 46/234, 161, 164, 173, 2, 3, 4, 5

[56] References Cited

U.S. PATENT DOCUMENTS

| | | | |
|---|---|---|---|
| 798,491 | 8/1905 | Bowen | 46/5 |
| 1,664,390 | 3/1928 | Dwight | 46/161 X |
| 2,955,752 | 10/1960 | Thomas | 46/2 X |
| 3,401,485 | 9/1968 | Goodrum, Jr. | 46/237 |

FOREIGN PATENT DOCUMENTS

| | | | |
|---|---|---|---|
| 169661 | 4/1951 | Austria | 46/236 |
| 864094 | 4/1941 | France | 46/238 |
| 526861 | 3/1955 | Italy | 46/161 |

*Primary Examiner*—Russell R. Kinsey
*Assistant Examiner*—Mickey Yu
*Attorney, Agent, or Firm*—Koda and Androlia

[57] ABSTRACT

A mechanical toy including at least one figure. The figure includes a leg assembly, a torso assembly; pivotally coupled to the leg assembly by a primary support pin, a head assembly pivotally coupled to the torso assembly by a secondary support pin which is parallel to the primary support pin and a permanent magnet disposed inside the head assembly.

7 Claims, 11 Drawing Figures

(a)

(b)

(a)

(b)

(a)

(b)

MAGNET EQUIPPED TOY THAT CHANGES POSTURE

BACKGROUND OF THE INVENTION

1. Field of the Invention

This invention relates to magnet equipped toys and more particularly to toys which include a figure which moves or changes posture as a result of the action of a magnet contained within the toy.

2. Prior Art

Magnet equipped toys designed so that the movement of a pair of human-type or animal-type dolls, etc., swing in a specified direction along a longitudinal line and come into contact when the dolls come into close proximity are universally known. Since such movement is relatively simple, such toys have not experienced great commercial success.

SUMMARY OF THE INVENTION

Accordingly it is a general object of the present invention to provide a magnet equipped toy which includes human-type or animal-type figures which pivot about at least two axises.

It is another object of the present invention to provide a magnet equipped toy which utilizes human-type or animal-type dolls which increases the commercial value of such magnet equipped toys by increasing the complexity of the change in posture.

It is another object of the present invention to provide a magnet equipped toy which utilizes human-type or animal-type dolls which is simple to manufacture and low in cost.

In keeping with the principles of the present invention, the object accomplished by a unique mechanical toy including at least one figure. The figure includes a leg assembly, a torso assembly pivotally coupled to the leg assembly by a primary support pin, a head assembly pivitally coupled to the torso assembly by a secondary support pin which is parallel to the primary support pin and a permanent magnet disposed inside the head assembly. In operation, when a pair of such figures in a mechanical toy approach and then separate from each other, not only do the head assemblies swing back and forth in response to the magnets but also the torso assemblies supporting the head assemblies are caused to swing back and forth. Thus, the figure is caused to move in a more complexed manner.

BRIEF DESCRIPTION OF THE DRAWINGS

The above mentioned features and objects of the present invention will become more appareant by reference to the following description taken in conjunction with the accompanying drawings wherein like reference numerials denote like elements and in which.

DETAILED DESCRIPTION OF THE INVENTION

Figure 2:
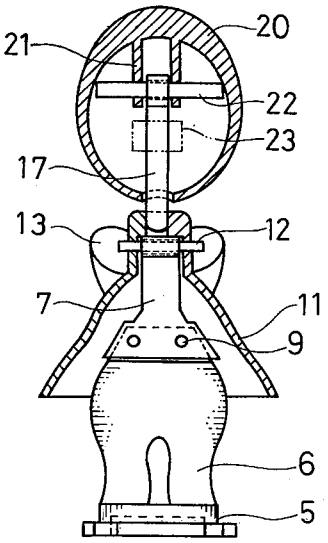
FIG. 2 is a cross-sectional view of the figure illustrated in FIG. 1 in a lateral direction.
Figure 1:
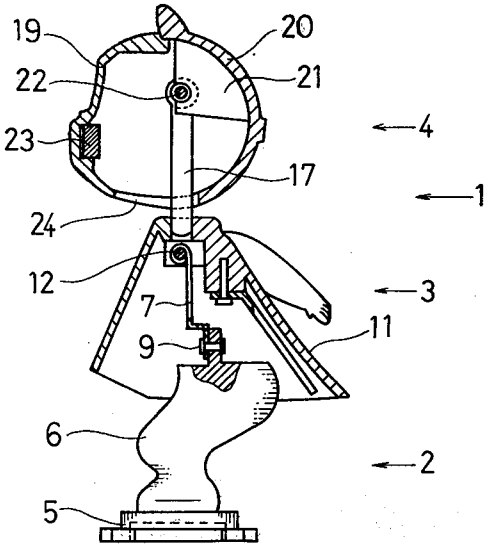
FIG. 1 is a cross-sectional view in a longitudinal direction of a magnet equipped doll in accordance with the teachings of the present invention.
Figure 3:
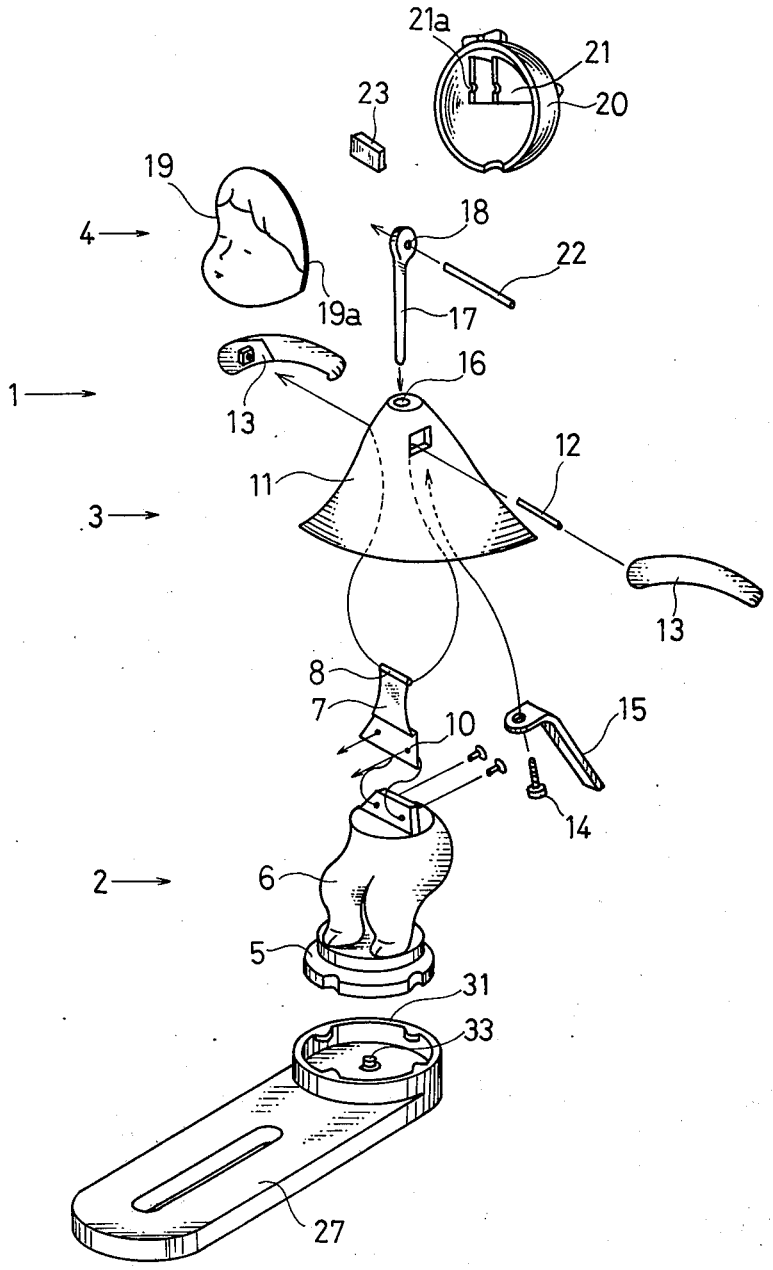
FIG. 3 is a exploded oblique view of the figure of FIG. 1.

Referring more particularly to the drawings, FIGS. 1 through 3 illustrate a magnet equipped doll 1. The magnet equipped doll 1 comprises a leg assembly 2, a torso assembly 3 and a head assembly 4. The leg assembly 2 consists of a stand 5, legs 6 and a support plate 7 which are fastened together to form an integral unit. The upper end of support plate 7 is bent around to form a lateral tube 8. Support plate 7 is fastened to the upper portion of leg 6 by chalking rivets 9 which pass through holes 10 in the lower end of support plate 7.

The torso assembly 3 includes a skirt 11 a primary support pin 12 which passes laterally through the upper portion of the skirt 11, a pair of arms (rights and left) 13 which are fastened to both ends of the primary support pin 12, a balance weight 15 which is fastened to the inside surface of the skirt 11 by means of a screw 14 and a head support rod 17 whose lower end is inserted and fastened in a vertical hole in the top of skirt 11. A lateral hole 18 passes through the upper end of the head support rod 17. The primary support pin 12 which passes through the upper portion of skirt 11 also passes through the lateral tube 8 of the leg assembly 2 so that the torso assembly 3 is pivotally supported on the leg assembly 2.

The head assembly 4 consists of a face part 19, a hat part 20 coupled to the face part 19 and a secondary support pin 22 which is fastened to slots 21*a* and supports leaves 21 projecting from the inside surface of the hat part 20 and also is fastened to the edges 19*a* of the face part 19. A permanent magnet 23 is further provided coupled to the inside surface of the face part 19. Furthermore, a longitudinal slot 24 is formed in the lower portion of the face part 19 and the hat part 20. The secondary support pin 22 is passed through the lateral hole 18 in the upper end of the head support rod 17 so that the head assembly 4 is pivitally supported on the torso assembly 3. Accordingly, the torso assembly 3 is free to swing back and forth on the primary support pin 12 within the limits determined by the space between the lower edge of the skirt 11 and the perimeter of the upper portion of the legs 6 while the head assembly 4 is free to swing back and forth on the secondary support pin 22 within the limits determined by the slot 24.

Figure 4:
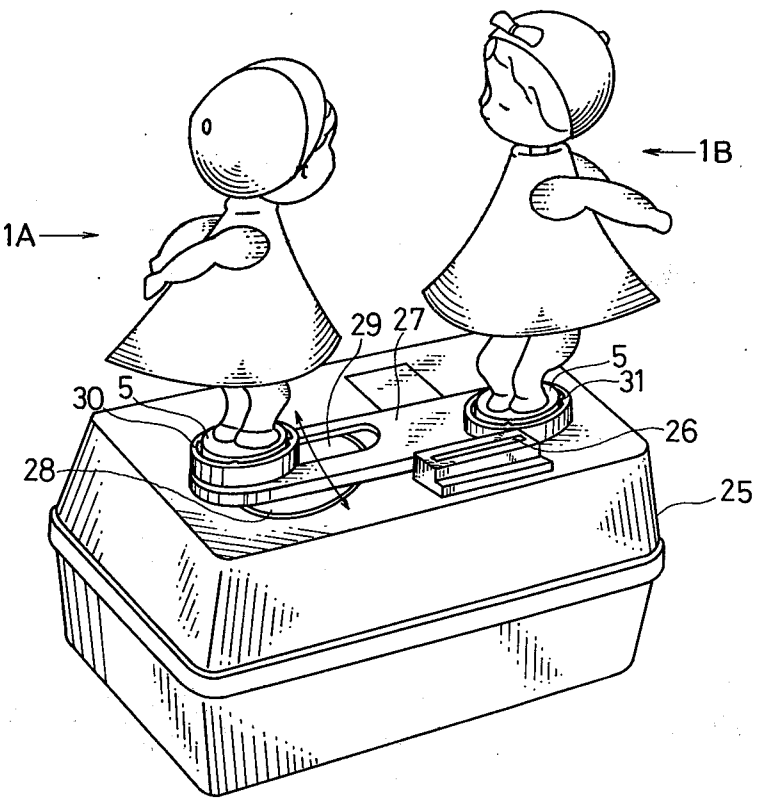
FIG. 4 is an oblique view of a bank toy which supports a pair of magnet equipped dolls.
Figure 5:
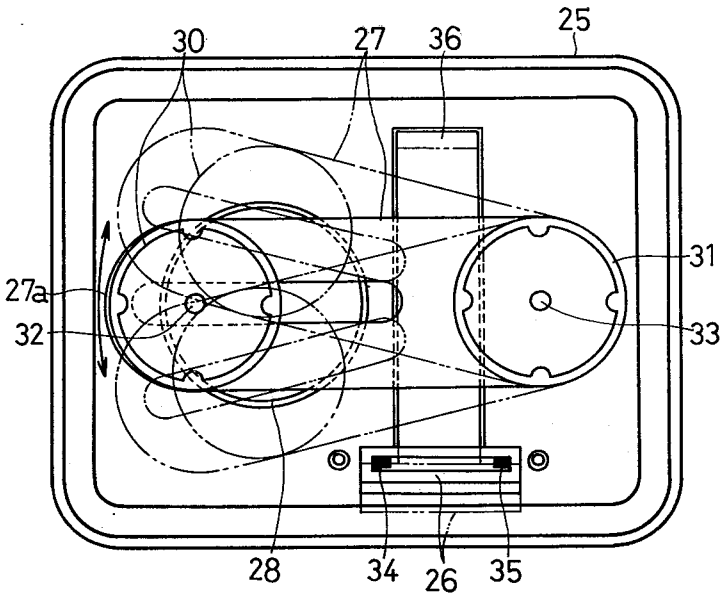
FIG. 5 is a planned view of the bank toy of FIG. 4.

Referring to FIG. 4, shown therein is a bank toy which employs a pair of magnetic equipped dolls of the design shown in FIGS. 1 through 3. A boy doll 1A and girl doll 1B are provided on the bank toy. The polarity of the permanent magnets 23 provided in the respective head assemblies of the boy doll 1A and the girl doll 1B is selected so that both dolls will be drawn into contact when they approach each other. The bank toy 25 includes a coin slot 26, a moving plate 27 and a rotating plate 28.

The rotating plate 28 is driven via a transmission mechanism by an electric motor provided within the bank 25. A pin 32 fastened to the rotating plate 28 at an eccentric point on the plate 28 passes through and projects from a slot 29 in the moving plate 27. A stand holder 30 is provided on the top of pin 32. Another stand holder 31 is formed on the other end of the moving plate 27. A pin 33 is fastened to the stand holder 31 and moving plate 27 is rotatively coupled to bank 25. The rotation of rotating plate 28 causes the end 27*a* of the moving plate 27 to move back and forth and causes the stand holder 30 to move about a circular path. The stand 5 of the boy doll 1A is coupled to the stand holder 30 so that it may be freely attached and removed. The stand 5 of the girl doll 1B is mounted in the stand holder 31 in a similar manner.

Two electric contacts 34 and 35 face each other in the coin slot 26. When a coin is inserted in the coin slot 26, the contacts 34 and 35 are shorted together so that the electric motor is connected to a battery. When the moving plate 27 swings, a sliding plate 26 moves back and forth, thereby causing the coin inside the slot 26 to move to the outside of the contacts 34 and 35. This removes the constraint applied to the coin so that it is caused to drop into the bank 25. Furthermore, the electric motor is arranged and configured such that a timer mechanism keeps it connected to the battery so that it continues to run for several seconds after the coin has dropped into the bank 25 and the short circuit between the contacts 34 and 35 is broken.

Figure 6:
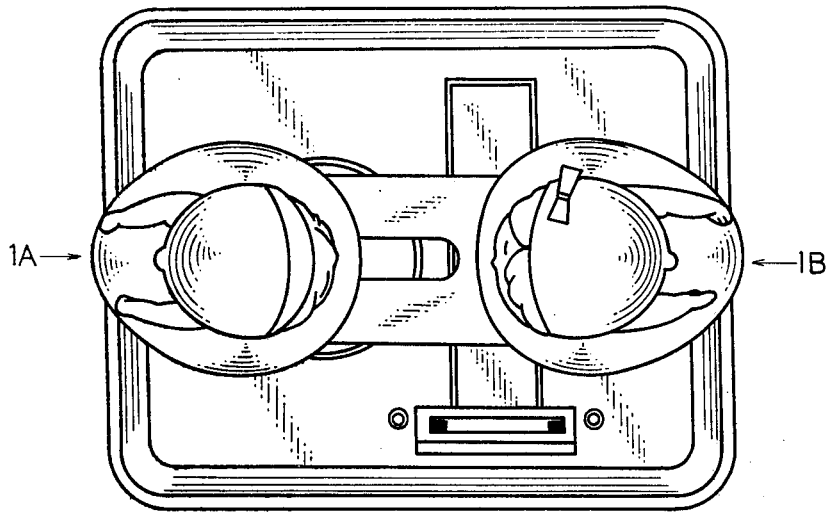
FIGS. 6A and 6B are descriptivie diagrams illustrating the natural posture of the magnetic equipped dolls utilized in the bank toy of FIG. 1 shown in plan and front views respectively.
Figure 6:
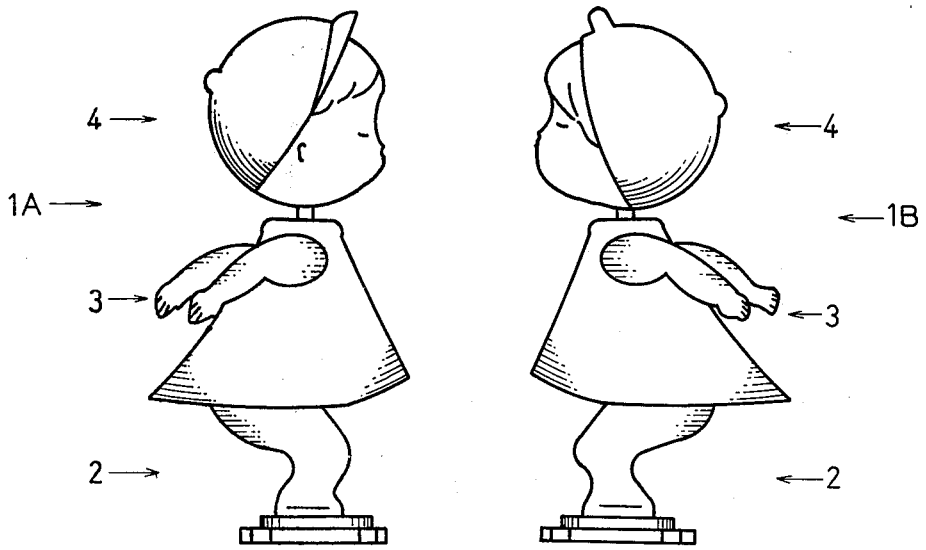

As the moving plate 27 swings, the stand holder 30 moves about a circular path and the dolls 1A and 1B move from a state of mutual separation as shown in FIG. 6 into a state of contact as shown in FIG. 7 and are then once again separated. The posture of the dolls as they began to separate from each other is shown in FIG. 8.

Figure 7:
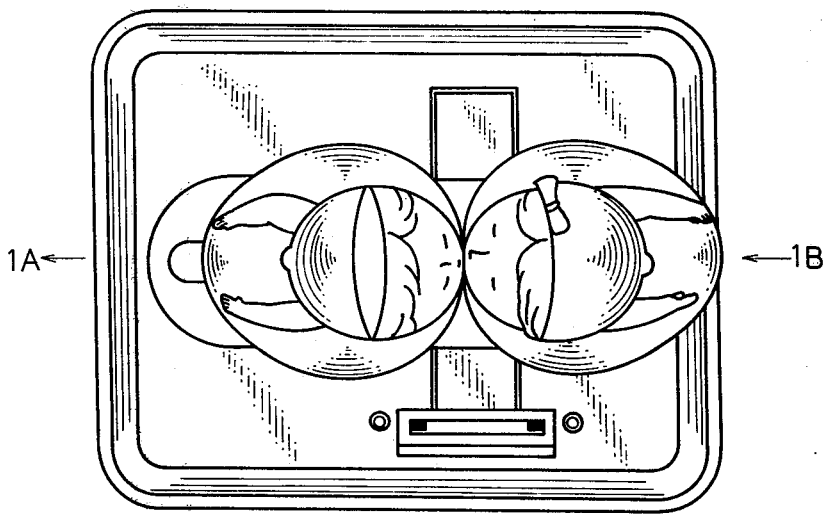
FIG. 7 is a descriptive diagram illustrating the contact posture of the figures utilized in bank of FIG. 4 shown in plan and front views respectively.
Figure 7:
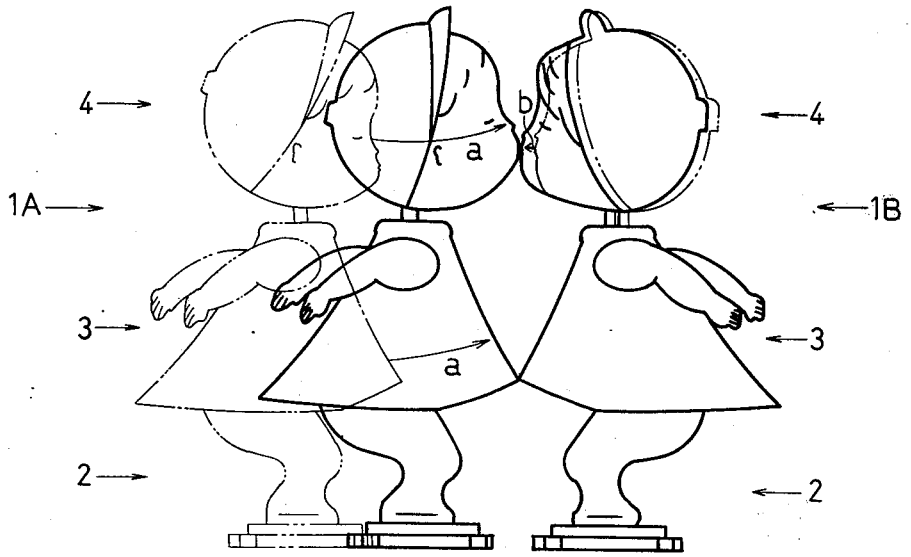
Figure 8:
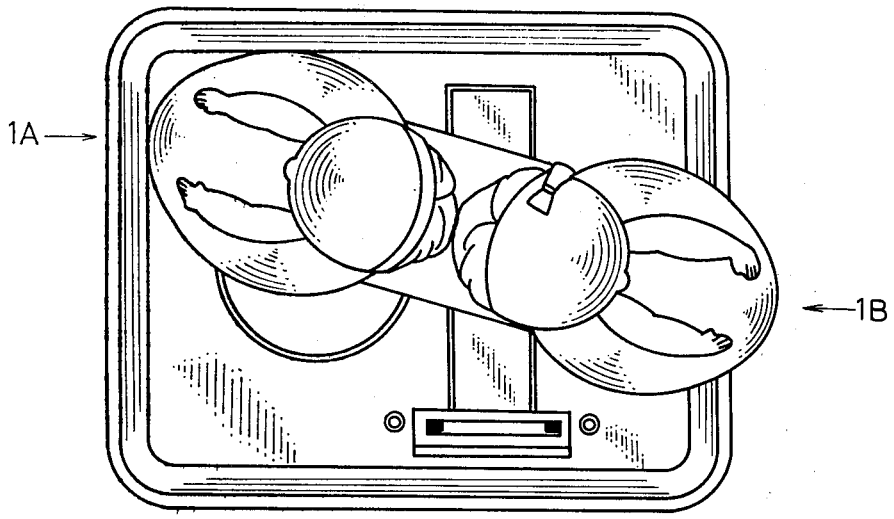
FIGS. 8A and 8B are descriptive diagrams illustrating the parting posture of the magnet equipped dolls utilized in the bank toy of FIG. 4 shown in plan and front views respectively.
Figure 8:
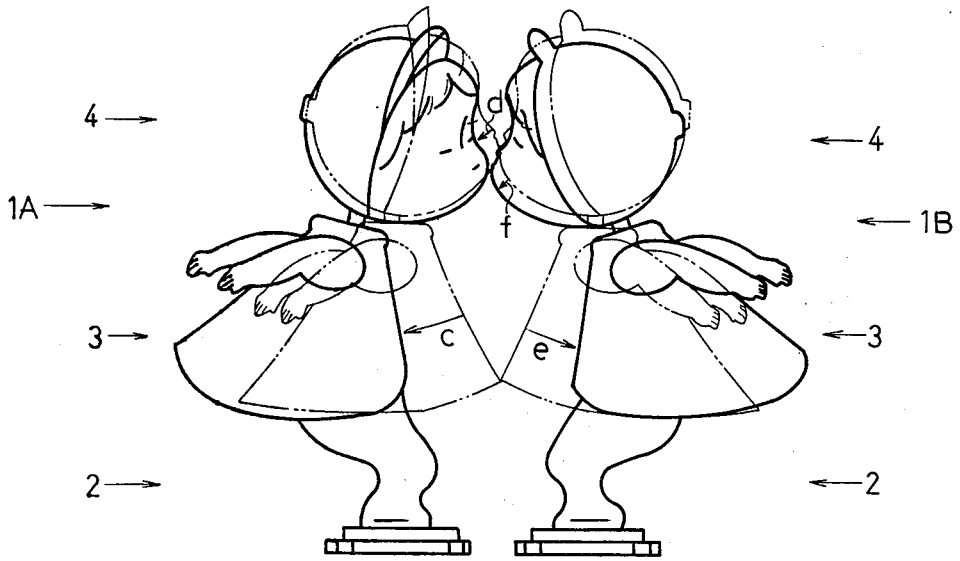

Specifically, the boy doll 1A advances in the direction a to the position of contact shown in FIG. 7 with almost no change in posture. Whereas the head assembly 4 of the girl doll 1B is caused to swing slightly forward in the direction indicated by arrow b. Then in the parting position shown in FIG. 8 the torso assemblies 3 of the boy doll 1A and the girl doll 1B move away from each other in the directions indicated by arrows c and e so that they are separated. As shown in FIG. 8, as the dolls part, the head assemblies 4 swing in the directions d and f so that contact is maintained as long as possible. Thus, the dolls exhibit a posture which gives them an impression that they are reluctant to part. Furthermore, the orientation of the stand holder 31 of the girl doll 1B changes as the moving plate 27 moves back and forth. In particular, the girl doll 1B will face slightly to the left as the boy doll 1A approaches and look straight ahead during contact and slightly to the right during parting.

Since as described above, the head aseembly containing the magnetic is pivotally supported on the leg assembly via the torso assembly so that pivoting occurs at two points, the movement of the torso assembly is added to the movement of the head aseembly so that the posture of the magnet equipped figure is changed in two stages. This two stage movement increases the amusement value of a toy utilizing such figures and thereby increases its commercial value.

In all cases, it is understood that the above described embodiment is merely illustrative of but one of the many possible specific embodiments which can represent the application of the principles of the present invention. Numerous and varying other arrangements can be readily devised in acordance with those principles by those skilled in the art without departing the spirit and scope of the invention.

I claim:

1. A mechanical toy comprising:

a hollow box;

a slot provided on said box and communicating with the interior of said box;

a sliding plate provided on said box;

a coin slot provided on said sliding plate superjacent said slot in said box;

an elongated moving plate pivotally coupled at a first end to said box, said moving plate having a longitudinal slot formed in a second end of said moving plate, said moving plate further being coupled to said slide plate such that said sliding plate oscillates when said moving plate is pivoted about said first end;

a motor driven rotating plate provided in a top of said box and subjacent said slot in said moving plate;

a holder being provided on said first and second ends of said moving plate, said holder on said second end being provided such that it slides back and forth in said longitudinal slot without rotating, said holder in said second end further being rotatably coupled to an eccentric point on said rotating plate; and a figure coupled to each of said holders, said figure comprising:

a leg assembly;

a support member coupled to said leg assembly;

a torso assembly pivotally coupled to said support member, said torso assembly including a skirt extending over said support member;

a support rod provided in a top of said torso assembly;

a head assembly pivotally coupled to said support rod, said support rod being pivotally coupled to a point located at substantially the center of said head; and a magnet provided inside a front portion of said head assembly.

2. A mechanical toy according to claim 1 wherein said pivotal coupling between said torso assembly and said leg assembly of said figure comprises:

a pair of arms;

a lateral tube member formed on said support member; and a first pin coupled at both ends to said arms and extending through lateral tube and said torso assembly.

3. A mechanical toy according to claim 2 wherein said pivotal coupling between said head assembly and torso assembly of said figure comprises a second pin parallel to said first pin which extends through said support rod and is coupled to said head assembly.

4. A figure for use in mechanical toys comprising:

a leg assembly;

a support member coupled to said leg assembly;

a torso assembly pivotally coupled to said support member, said torso assembly including a skirt extending over said support member;

a support rod provided in a top of said torso assembly;

a head assembly pivotally coupled to said support rod, said support rod being pivotally coupled to a point located at substantially the center of said head; and a magnet provided inside a front portion of said head assembly.

5. A figure for use in mechanical toys according to claim 4 wherein said pivotal coupling between said torso assembly and said leg assembly of said figure comprises:

a pair of arms;

a lateral tube member formed on said supprt member; and a first pin coupled at both ends to said arms and extending through said lateral tube and said torso assembly.

6. A figure for use in mechanical toys according to claim 5 wherein said pivotal coupling between said head assembly and said torso assembly of said figure comprises a second pin parallel to said first pin which extends through said support rod and is coupled to said head at both ends.

7. A figure for use in mechanical toys according to claim 6 further comprising a longitudinal slot formed in a bottom of said head assembly and through which said support rod extends.

* * * * *